US007751755B2

(12) United States Patent
Yamaguchi

(10) Patent No.: US 7,751,755 B2
(45) Date of Patent: Jul. 6, 2010

(54) IMAGE FORMING APPARATUS

(75) Inventor: Yasuo Yamaguchi, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 448 days.

(21) Appl. No.: 11/905,673

(22) Filed: Oct. 3, 2007

(65) Prior Publication Data

US 2008/0085130 A1 Apr. 10, 2008

(30) Foreign Application Priority Data

Oct. 4, 2006 (JP) ..... 2006-272805

(51) Int. Cl.
*G03G 21/14* (2006.01)

(52) U.S. Cl. ..... 399/167; 399/27

(58) Field of Classification Search ..... 399/27, 399/44, 167

See application file for complete search history.

(56) References Cited

U.S. PATENT DOCUMENTS 5,043,595 A * 8/1991 Sugiyama ..... 307/39
2003/0016965 A1* 1/2003 Matsumoto ..... 399/167
2004/0223785 A1* 11/2004 Abe ..... 399/167
2004/0253008 A1* 12/2004 Chapman et al. ..... 399/13
2007/0092297 A1* 4/2007 Shimura et al. ..... 399/167

FOREIGN PATENT DOCUMENTS

JP 2004-138840 5/2004
JP 2005-300868 10/2005
JP 2006-126502 5/2006

* cited by examiner

*Primary Examiner*—David M Gray
*Assistant Examiner*—G. M. Hyder
(74) *Attorney, Agent, or Firm*—Harness, Dickey & Pierce, PLC

(57) ABSTRACT

A disclosed image forming apparatus includes plural image creating units arranged along a belt surface of a transfer belt; a first electric motor for driving a fixing unit; a second electric motor for driving one of the image creating units and the transfer belt; a third electric motor for driving the rest of the image creating units; a detecting unit for detecting a remaining toner amount in each image creating unit; a timing setting unit for determining a startup timing according to the remaining toner amount and delaying the startup timing if the remaining toner amount is large; and a startup control unit for starting up each of the first electric motor, the second electric motor, and, according to need, the third electric motor, one at a time after the preceding one has been started up, according to the determined startup timings.

17 Claims, 6 Drawing Sheets

IMAGE FORMING APPARATUS

BACKGROUND OF THE INVENTION

1. Field of the Invention

The present invention relates to an electrophotographic image forming apparatus including plural image creating units, in which an image creating mechanism is driven by plural electric motors. This image forming apparatus can be used as a printer, a copier, and a facsimile machine.

2. Description of the Related Art

There are image forming apparatuses that include plural image creating units, such as a tandem color copier in which a black image creating unit, a magenta image creating unit, a cyan image creating unit, and a yellow image creating unit are arranged along an intermediate transfer belt in this order from the upstream side of the movement direction of the intermediate transfer belt. Because a large machine load needs to be driven in such an image forming apparatus, plural electric motors are often employed (see, for example, patent documents 1 and 2). In order to reduce noise emitted when the electric motors drive the mechanism and to reduce power consumption, there has been proposed a technology for driving the image creating units and the intermediate transfer belt with separate DC brushless motors (see patent document 2).

However, even in a case where the operation of driving the machine load is divided among plural electric motors, the following problem occurs. Because the startup current value of each electric motor is high, if all of the electric motors are simultaneously started up at substantially the same time as the image forming apparatus is started up, the load current for starting up the apparatus will be extremely high. Such an extremely high load may be reported to the power source as an abnormal load, and the power source may be automatically shut off. In order to avoid such a situation and to start up the apparatus in a quick and efficient manner, the startup timings of the electric motors are shifted from each other, so that the startup currents, which would otherwise coincide with each other, are chronologically distributed. For example, patent document 1 discloses a startup control method of measuring the startup current value of each electric motor, saving the measured values, and determining the individual startup timings of each electric motor.

However, because the startup current of each electric motor needs to be measured individually, it is time consuming to measure all of the electric motors. Furthermore, there is a need to provide a special current detecting circuit for detecting a startup current that fluctuates at high speed, which leads to increased cost. Moreover, the electric motor load in an electrostatic image forming apparatus frequently fluctuates. For example, the temperature inside the image forming apparatus fluctuates over a wide range, and the machine load fluctuates according to the temperature. The load fluctuation caused by the temperature fluctuation causes fluctuations in the frictional resistance as the motion mechanism expands and contracts. Furthermore, in an electrophotographic image forming apparatus for forming an electrostatic latent image and developing the image with toner, the driving load of the developing unit fluctuates considerably. The fluidity of toner fluctuates due to fluctuations in the temperature and humidity, and the rotational load of a conveying/stirring screw fluctuates due to fluctuations in the remaining amount of toner in the developing unit. Even though such fluctuations occur, it is necessary to constantly prevent the startup currents of different electric motors from coinciding with each other, so that the total load does not become excessively high. Accordingly, the startup currents of the electric motors need to be frequently measured individually, and the measurement data in the memory needs to be frequently rewritten. If there are long time intervals between operations of individually measuring the startup currents of the electric motors and rewriting the memory data, the current values in the memory will not reflect load fluctuations caused by fluctuations in the remaining amount of toner, temperature, humidity, and the like. As a result, the startup load cannot be reliably distributed. It is necessary to determine the appropriate timings for measuring the startup currents and rewriting the memory data.

Patent Document 1: Japanese Laid-Open Patent Application No. 2004-138840

Patent Document 2: Japanese Laid-Open Patent Application No. 2005-300868

SUMMARY OF THE INVENTION

The present invention provides an image forming apparatus in which one or more of the above-described disadvantages are eliminated.

A preferred embodiment of the present invention provides an image forming apparatus in which startup loads of plural electric motors can be reliably distributed without significantly increasing the power source capacity, and without employing an electric circuit for detecting the startup current values of the electric motors.

An embodiment of the present invention provides an image forming apparatus including a photoconductor configured to rotate; a charging unit configured to charge the photoconductor; plural image creating units arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a first electric motor configured to drive the fixing unit; a second electric motor configured to drive at least one of the image creating units and drive the transfer belt; a third electric motor configured to drive at least one of the image creating units that is not driven by the second electric motor; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; and a startup control unit configured to start up each of the first electric motor, the second electric motor, and, according to need, the third electric motor, one at a time after the preceding one has been started up, wherein the electric motor to be started up after the second electric motor has been started up, is started up at a startup timing delayed with respect to the startup of the second electric motor, which startup timing is determined according to a state of the image creating unit driven by the second electric motor; and the electric motor to be started up after the third electric motor has been started up, is started up at a startup timing delayed with respect to the startup of the third electric motor, which startup timing is determined according to the state of the image creating unit driven by the third electric motor, wherein the state includes said remaining toner amount.

An embodiment of the present invention provides an image forming apparatus including a photoconductor configured to rotate; a charging unit configured to charge the photoconductor; a black image creating unit, a magenta image creating unit, a cyan image creating unit, and a yellow image creating unit, which are arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a first electric motor configured to drive the fixing unit; a second electric motor configured to drive the black image creating unit and the transfer belt; a third electric motor configured to drive the magenta image creating unit, the cyan image creating unit, and the yellow image creating unit; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; and a startup control unit configured to start up the electric motors, wherein in the event of receiving a color printing instruction, the startup control unit first starts up the first electric motor, and then starts up the second electric motor after the first electric motor has been started up at a startup timing determined for the first electric motor, and then starts up the third electric motor after the second electric motor has been started up at a startup timing determined according to a state of the image creating unit driven by the second electric motor; and in the event of receiving a monochrome printing instruction, the startup control unit first starts up the second electric motor, and then starts up the first electric motor after the second electric motor has been started up at the startup timing determined according to the state of the image creating unit driven by the second electric motor, wherein the state includes said remaining toner amount.

An embodiment of the present invention provides an image forming apparatus including a photoconductor configured to rotate; a charging unit configured to charge the photoconductor; a black image creating unit, a magenta image creating unit, a cyan image creating unit, and a yellow image creating unit, which are arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a fixing temperature detecting unit configured to detect a fixing temperature of the fixing unit; an energy saving control unit configured to set a mode of the image forming apparatus, wherein an operation mode is set immediately after an original power source switch is switched on so that an operation voltage is supplied to units in the image forming apparatus, an energy saving mode is set if no printing instructions are received for a predetermined length of time so that power is stopped from being supplied to circuits in the image forming apparatus that consume a large amount of power, and the operation mode is set in response to receiving a printing instruction during the energy saving mode; a first electric motor configured to drive the fixing unit; a second electric motor configured to drive the black image creating unit and the transfer belt; a third electric motor configured to drive the magenta image creating unit, the cyan image creating unit, and the yellow image creating unit; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; a main power source activation startup control unit configured to start up the electric motors, wherein when the image forming apparatus is started up as the original power source switch is switched on, in the event that the fixing temperature is less than a specified value, the main power source activation startup control unit first starts up the second electric motor, then starts up the third electric motor after the second electric motor has been started up at a startup timing determined according to a state of the image creating unit driven by the second electric motor, then starts up the first electric motor after the third electric motor has been started up at a startup timing determined according to the state of the image creating unit driven by the third electric motor, and when the image forming apparatus is started up as the original power source switch is switched on, in the event that the fixing temperature is more than or equal to the specified value, the main power source activation startup control unit first starts up the first electric motor, then starts up the second electric motor after the first electric motor has been started up at a startup timing determined for the first electric motor, and then starts up the third electric motor after the second electric motor has been started up at the startup timing determined according to the state of the image creating unit driven by the second electric motor; and a resumption startup control unit configured to startup the electric motors, wherein when the operation mode is set in response to receiving the printing instruction during the energy saving mode, in the event that the printing instruction is a color printing instruction, the resumption startup control unit first starts up the first electric motor, then starts up the second electric motor after the first electric motor has been started up at the startup timing determined for the first electric motor, and then starts up the third electric motor after the second electric motor has been started up at the startup timing determined according to the state of the image creating unit driven by the second electric motor, and when the operation mode is set in response to receiving the printing instruction during the energy saving mode, in the event that the printing instruction is a monochrome printing instruction, the resumption startup control unit first starts up the second electric motor, and then starts up the first electric motor after the second electric motor has been started up at the startup timing determined according to the state of the image creating unit driven by the second electric motor, wherein the state includes said remaining toner amount.

According to one embodiment of the present invention, an image forming apparatus is provided, in which startup loads of plural electric motors can be reliably distributed without particularly increasing the power source capacity, and without employing an electric circuit for detecting the startup current values of the electric motors.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
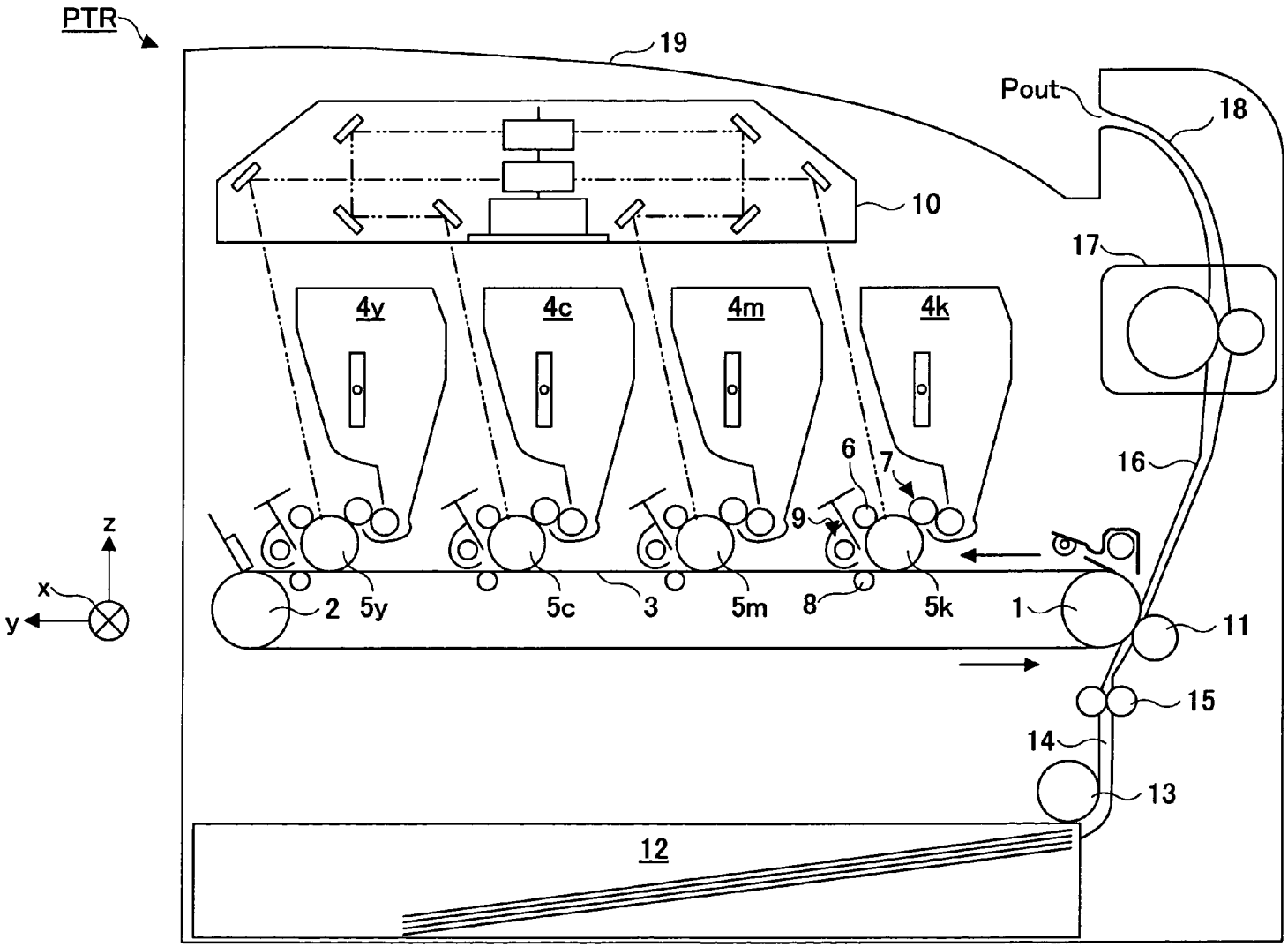
FIG. 1 is a sectional view of an image creating mechanism of a printer according to an embodiment of the present invention.

FIG. 1 illustrates a laser printer according to an embodiment of the present invention. PTR denotes the laser printer acting as an image forming apparatus. The printer PTR includes a paper feeding tray 12, a paper feeding roller 13, a conveying path 16, an intermediate transfer belt 3, image creating units 4 (*k, m, c, y*), photoconductors 5 (*k, m, c, y*), a tension roller 2, a driving roller 1, a cleaning device, a secondary transfer roller 11, a fixing unit 17, cleaners 9, and a paper feeding path 14.

On the paper feeding tray 12, blank paper sheets are stacked. The paper feeding roller 13 sequentially feeds the sheets stacked on the paper feeding tray 12 into the conveying path 16, starting from the top sheet. Each of the sheets that have been separated one by one and fed into the conveying path 16 is conveyed to the secondary transfer roller 11 at such a timing that an image on the intermediate transfer belt 3 can be transferred onto the sheet. The intermediate transfer belt 3 is wound around the driving roller 1 and the tension roller 2. The intermediate transfer belt 3 is driven by the driving roller 1, and is prevented from sagging by the tension roller 2. The printer PTR is a so-called tandem type printer, in which image creating units 4 (*k, m, c, y*) corresponding to four complementary colors are arranged along the intermediate transfer belt 3. In FIG. 1, k denotes black, m denotes magenta, c denotes cyan, and y denotes yellow. Each of the image creating units 4 includes one of the photoconductors 5 (*k, m, c, y*) capable of carrying a toner image of the corresponding color.

In FIG. 1, the intermediate transfer belt 3 rotates in a counterclockwise direction. Plural image creating units 4*k*, 4*m*, 4*c*, and 4*y* are arranged from the upstream side of this rotational direction in the stated order. The image creating units 4*k*, 4*m*, 4*c*, and 4*y* form toner images of different colors but otherwise have the same internal structure. In the following, when descriptions are given for contents common to all of the image creating units 4 or all of the photoconductors 5, these elements are referred to as image creating unit 4 and photoconductor 5, respectively.

Above the image creating units 4*k*, 4*m*, 4*c*, and 4*y*, a laser scanner 10 is provided. The laser scanner 10 irradiates laser beams onto each photoconductor 5 charged by a corresponding charging roller 6, which laser beams are modulated with image data for exposing the photoconductor 5 with images of the respective colors. The laser scanner 10 repeatedly scans each photoconductor 5 in a main scanning direction x that is perpendicular to a movement direction y of the intermediate transfer belt 3. Accordingly, an electrostatic latent image is formed on the photoconductor 5. The electrostatic latent image is developed into a toner image by a developer 7.

The toner image is transferred onto the intermediate transfer belt 3 by a primary transfer roller 8 near a position where the photoconductor 5 and the intermediate transfer belt 3 contact each other (primary transfer position). According to this transfer operation, a toner image is formed on the intermediate transfer belt 3.

AS described above, a position on the intermediate transfer belt 3 onto which a black toner image is transferred by the developer 7 in the black image creating unit 4*k* is conveyed to the next image creating unit 4*m*, if a color printing request has been made. At the image creating unit 4*m*, the same image forming process performed by the image creating unit 4*k* is performed, so that a magenta toner image is formed on the photoconductor 5*m*. This magenta toner image transferred onto the intermediate transfer belt 3 to be superposed onto the black image.

This position of the intermediate transfer belt 3 is then conveyed to the subsequent image creating units 4*c*, 4*y*. By the same operations as above, a cyan toner image formed on the photoconductor 5*c* and a yellow toner image formed on the photoconductor 5*y* are transferred onto the transfer belt 3 to be superposed onto the black and magenta images. Accordingly, a full-color image is formed on the intermediate transfer belt 3. The position of the intermediate transfer belt 3 on which the full-color superposed image is formed is conveyed to the position of the secondary transfer roller 11, where the full-color image on the intermediate transfer belt 3 is transferred onto a sheet. After the toner image has been transferred onto the sheet, unnecessary toner remaining on the intermediate transfer belt 3 that has failed to be transferred to the sheet is removed by the cleaning device near the driving roller 1, to be prepared for the next image forming operation.

The fixing unit 17 heat seals the toner image transferred onto the sheet, so that the toner image is fixed onto the sheet. There is a fixing roller arranged inside the fixing unit 17. When the fixing roller receives power from a not shown heater driver, heat is generated so that the fixing roller is heated. The sheet that has passed through the fixing unit 17 passes through a paper output path 18. Then, the sheet is sent by a paper output roller onto a paper output tray 19 outside a paper outlet Pout.

In the image forming operation, if only a black image is to be printed (monochrome printing), the photoconductor 5*m*, the photoconductor 5*c*, and the photoconductor 5*y* will be withdrawn to positions spaced away from the intermediate transfer belt 3, and the image forming process will only be performed for black.

In each of the image creating units 4*k* through 4*y*, the developing unit includes a remaining toner sensor and the fixing unit 17 includes a fixing temperature sensor for detecting the temperature of the fixing roller (fixing temperature). Inside the apparatus body of the printer PTR, there is provided a temperature sensor (in-apparatus temperature sensor) for detecting the temperature inside the printer PTR and a humidity sensor (in-apparatus humidity sensor) for detecting the humidity inside the printer PTR.

Figure 2:
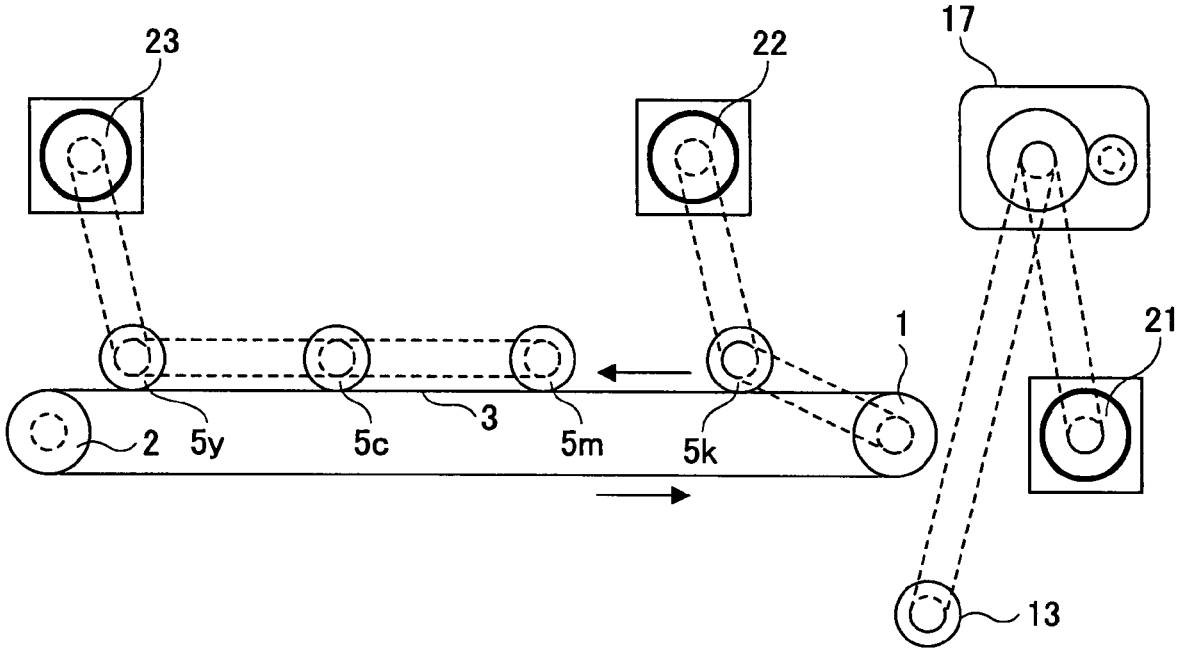
FIG. 2 is a block diagram of driving sources included in the image creating mechanism shown in FIG. 1.

FIG. 2 illustrates driving sources for the fixing unit 17, the paper feeding roller 13, the intermediate transfer belt 3, and the image creating units 4*k* through 4*y* shown in FIG. 1. The printer PTR according to an embodiment of the present invention includes a first electric motor 21 for driving the paper feeding roller 13 and the fixing unit 17, a second electric motor 22 for driving at least one image creating unit among the plural image creating units 4*k*, 4*m*, 4*c*, and 4*y* (the image creating unit 4*k*, in the case of FIG. 2) and the driving roller 1 supporting the intermediate transfer belt 3, and a third electric motor 23 for driving the image creating units other than the one driven by the second electric motor 22 (the image creating units 4*m*, 4*c*, and 4*y*, in the case of FIG. 2). The paper feeding roller 13 is connected to the first electric motor 21 via a clutch only when feeding a sheet, and therefore, the paper feeding roller 13 is not driven when the first electric motor 21 is started up. Accordingly, the paper feeding roller 13 does not become a startup load of the first electric motor 21.

Figure 3:
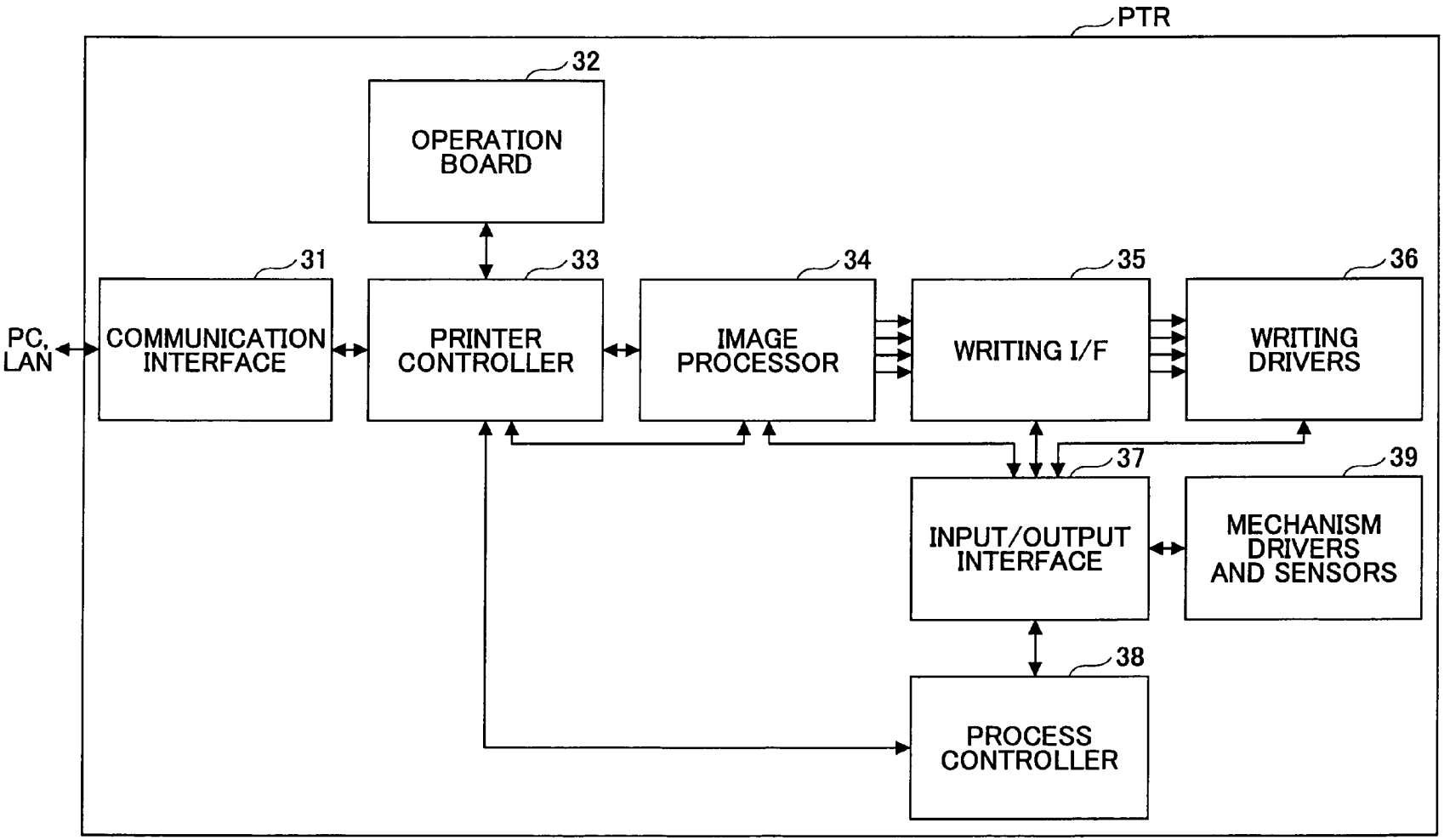
FIG. 3 is a block diagram of an image processing system of the printer shown in FIG. 1.

FIG. 3 is a block diagram of an image processing system of the printer PTR shown in FIG. 1. A personal computer PC is directly connected or connected via a LAN, an Ethernet (registered trademark), or another network, via a communication interface 31. A printing command is given to a printer controller 33 from the PC, or from an operation board 32. The printing command includes a sheet size, an indication of a color/monochrome printing operation, other printing conditions, and graphic information. The printer controller 33 expands the graphic information in the received printing command into image data, and outputs the image data to an image processor 34. The image processor 34 converts the image data into color image data for each of the colors, so as to be compatible with printing operations performed by the image creating mechanism shown in FIG. 1, and outputs the image color data to a writing I/F 35 according to an image creating process control operation performed by a process controller 38. The writing I/F 35 turns on/off or modulates laser diodes of the laser scanner 10 in the image creating mechanism, for recording each of the color images according to the color image data corresponding to each of the colors.

The drivers and sensors in the mechanism of the printer PTR shown in FIG. 1 correspond to the block of mechanism drivers and sensors 39, including various sensors such as the remaining toner sensors in the developers, the fixing temperature sensor, the in-apparatus temperature sensor, and the in-apparatus humidity sensor; detecting circuits for energizing these sensors; and drivers for energizing or driving actuators (electric motors, solenoids) including the first through third electric motors 21 through 23. The mechanism drivers and sensors 39 block is connected to an input/output interface 37. The process controller 38 reads detection signals of the various sensors via the input/output interface 37, and drives the actuators of the image creating units (writing drivers) 36 via the input/output interface 37. Furthermore, the process controller 38 controls the operation timings and the signal input/output timings of the image processor 34 and the writing I/F 35 via the input/output interface 37.

Figure 4:
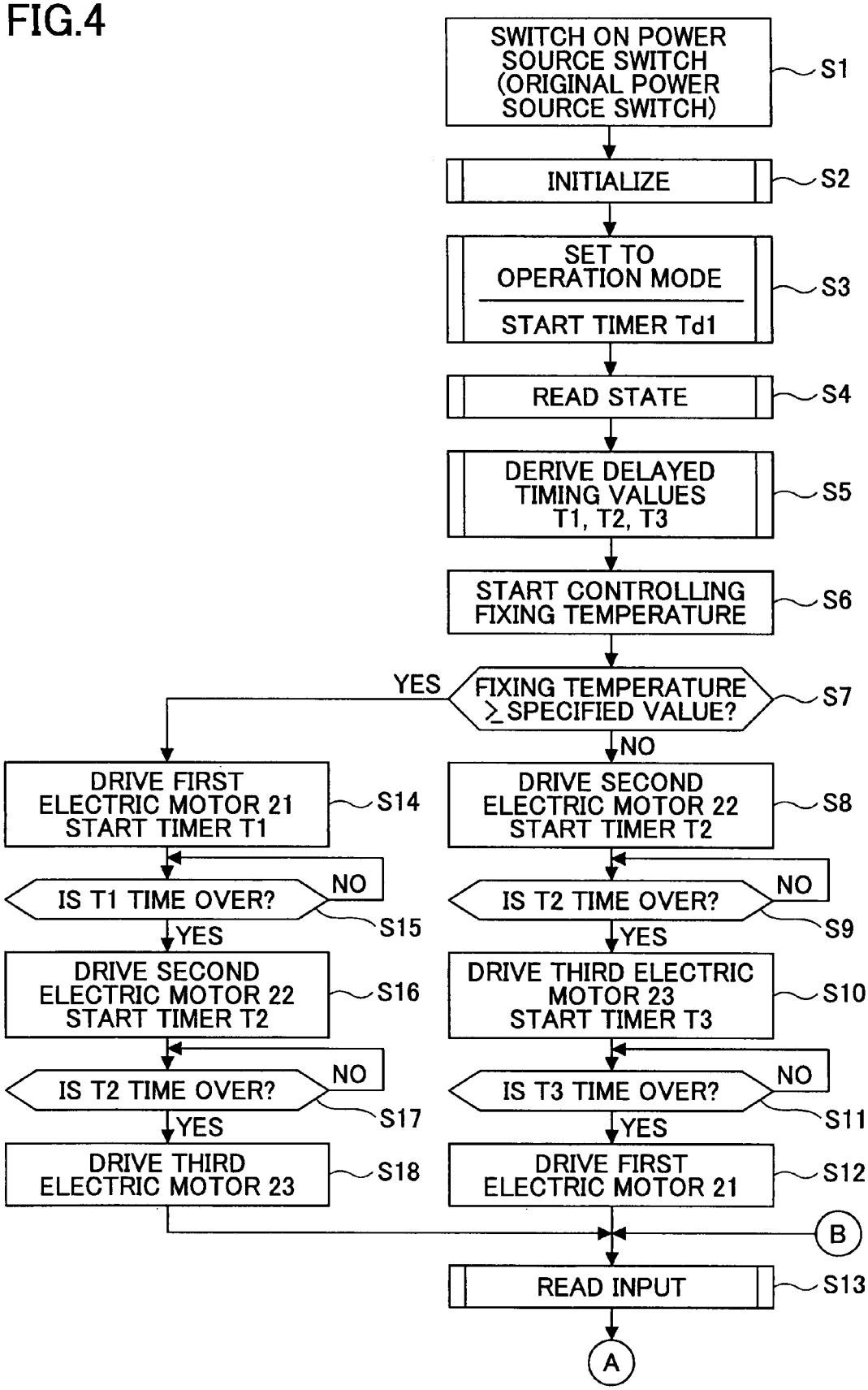
FIG. 4 is the first half of a flowchart of a printer control operation executed by a printer controller with the use of a process controller shown in FIG. 3.
Figure 5:
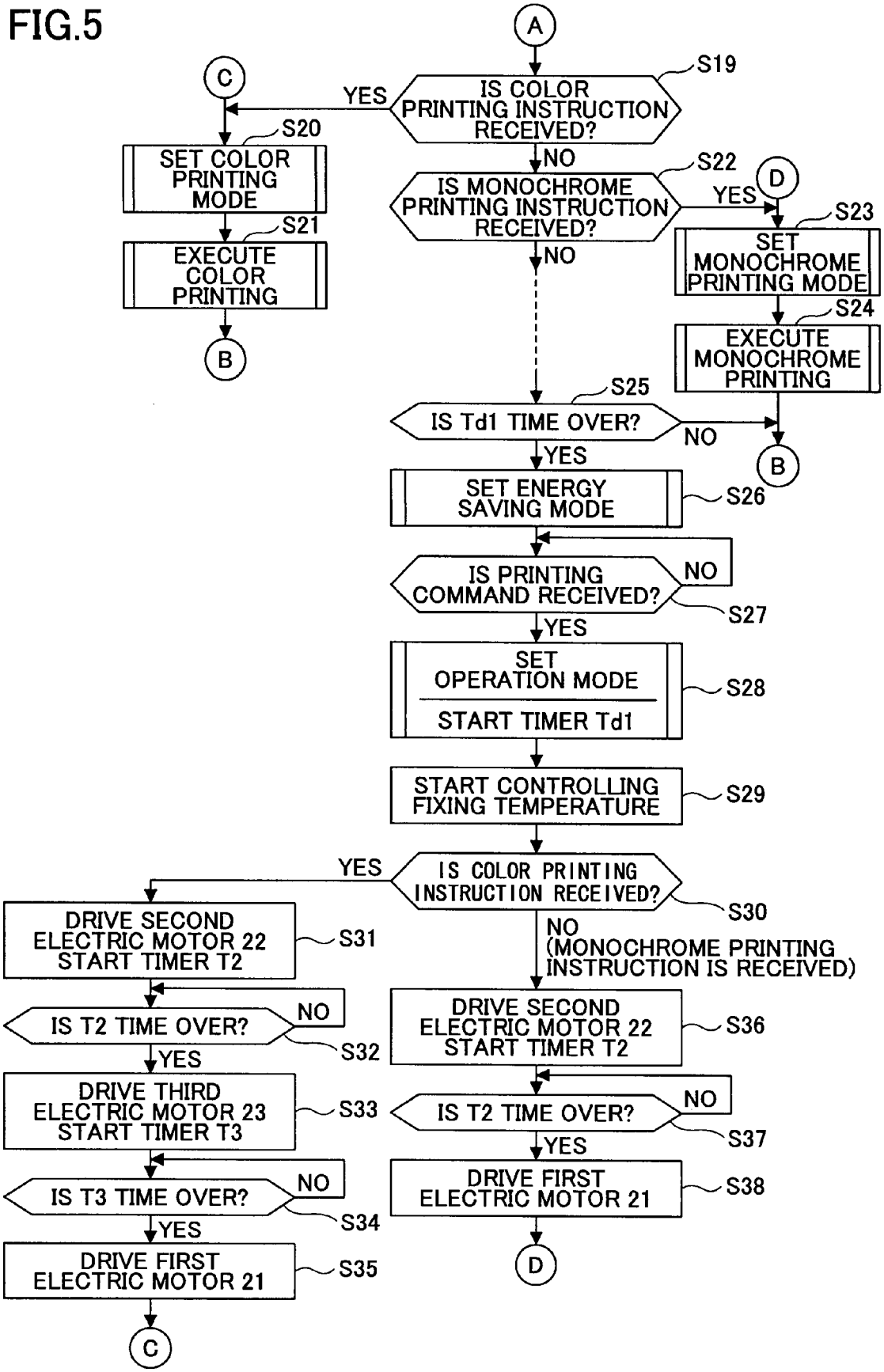
FIG. 5 is the second half of the flowchart of the printer control operation executed by the printer controller with the use of the process controller shown in FIG. 3.

FIGS. 4 and 5 are flowcharts of a printer control operation executed by the printer controller 33 with the use of the process controller 38. A not shown original power source switch is switched on and an operation voltage is supplied to the printer PTR (step S1). The printer controller 33 resets itself, and then sets all units in the printer PTR to an initial status (step S2). The printer controller 33 sets a power source circuit to an "operation mode" for applying an operation voltage necessary for an image creating operation to each of the units. A timer Td1 indicating a time value Td1 is started (step S3).

Next, at "read state" (step S4), the process controller 38 reads the values detected by the remaining toner sensors in the developing units of the image creating units 4*k* through 4*y* (remaining toner amount), the value detected by the fixing temperature sensor (fixing temperature), the value detected by the in-apparatus temperature sensor (in-apparatus temperature), and the value detected by the in-apparatus humidity sensor (in-apparatus humidity), and derives delayed timing values T1, T2, and T3 based on these values (step S5).

The delayed timing value T1 is the delayed time value starting from the point where the first electric motor 21 is started up until another electric motor (second electric motor 22 or third electric motor 23) is started up. The delayed timing value T2 is the delayed time value starting from the point where the second electric motor 22 is started up until another electric motor (third electric motor 23 or first electric motor 21) is started up. The delayed timing value T3 is the delayed time value starting from the point where the third electric motor 23 is started up until another electric motor (first electric motor 21 or second electric motor 22) is started up.

Figure 6:
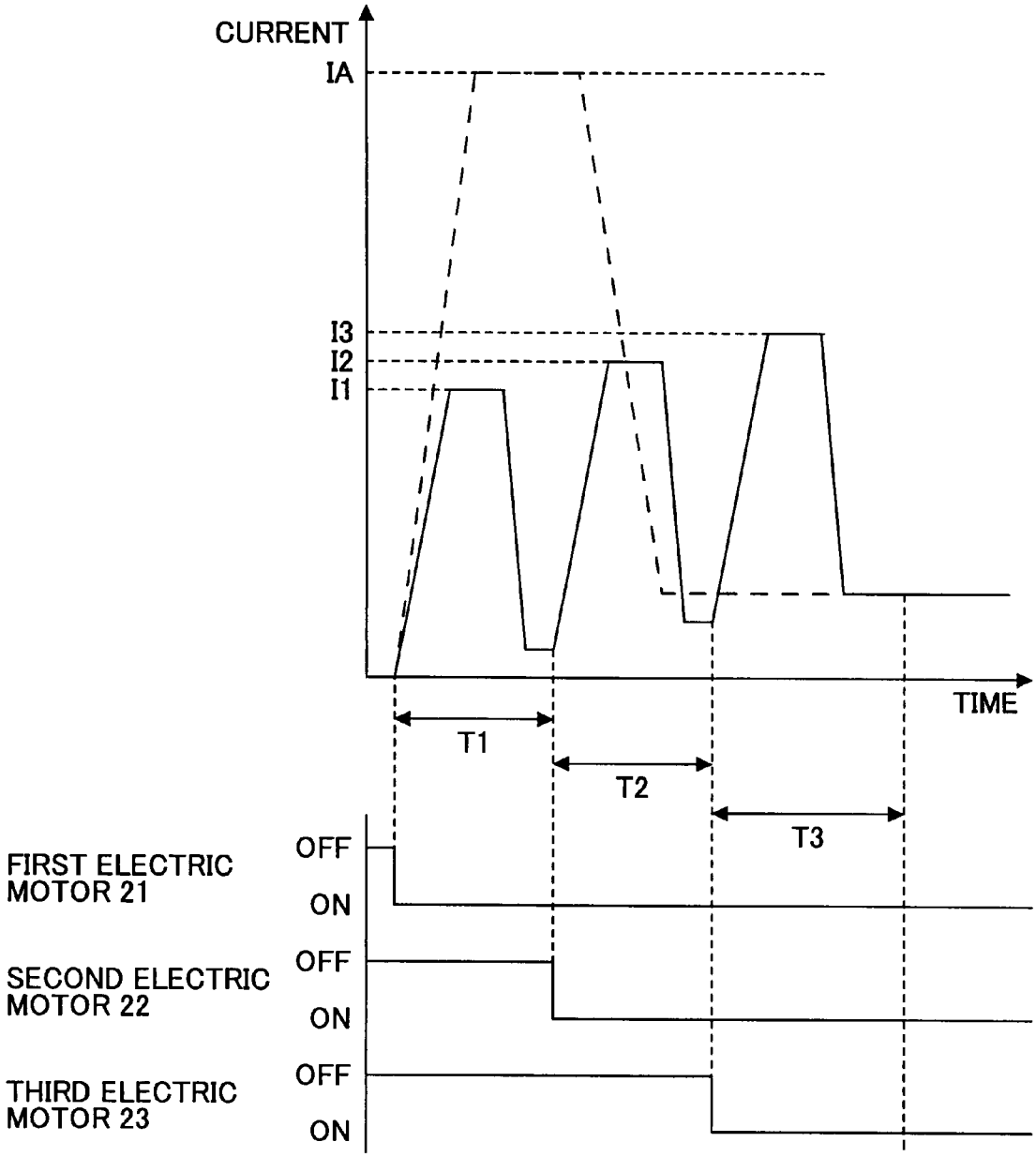
FIG. 6 is a graph illustrating the transition of startup currents of the first through third electric motors shown in FIG. 2.

The process of deriving the delayed timing values T1, T2, and T3 is described. The first through third electric motors are DC brushless motors. As an example, a description is given of a case where the second electric motor 22 is started up when a predetermined time T1 has passed since the startup of the first electric motor 21 and the third electric motor 23 is started up when a predetermined time T2 has passed since the startup of the second electric motor 22, as shown in FIG. 6. In each DC brushless motor, a startup time is defined as being the time from the point when it is started up until its rotational speed becomes stabilized at a steady rotational speed. The startup time can be predicted in advance according to conditions of the load.

The conditions of the load include fluctuations in the compression load for pressurizing sheets and fluctuations in the rotational friction caused by expansion and contraction of the mechanism, which expansion and contraction occur due to fluctuations in the temperature of the fixing roller. The startup load of the first electric motor 21 is the fixing unit 17. The actuating load of the fixing roller is the fixing temperature (temperature of fixing mechanism). If the temperature is low, the actuating load will be high. Accordingly, the following formula (1) is used to calculate the startup time of the first electric motor 21 or a delayed timing value T1 that is slightly longer than the startup time of the first electric motor 21. The calculated value is amended according to an actually measured value. A timing value table (look-up table) for T1 is generated and provided in the process controller 38, which table includes address values corresponding to fixing temperature levels that are parameters, in association with data to be read that is a delayed timing value at each of the parameter values.

$T1$=startup time at standard temperature×fixing temperature coefficient fixing temperature coefficient=function using fixing temperature of fixing unit 17 as parameter (1)

The load of the developing unit is primarily the image creating unit. The developing unit load corresponds to the remaining toner amount in the developing unit and the toner viscosity determined by the temperature and humidity. The load of the fixing unit 17 is the friction resistance of the motion mechanism determined by the fixing temperature (mechanism temperature). As the remaining toner in the image creating unit 4 increases and the temperature and humidity increases, the driving load of the image creating unit will become higher.

The present embodiment takes advantage of these properties. The following formulae (2) and (3) are used to calculate the startup times of the second electric motor 22 and the third electric motor 23 or delayed timing values T2 and T3 that are slightly longer than the startup times of the second electric motor 22 and the third electric motor 23, respectively. The calculated values are amended according to actually measured values. A timing value table (look-up table) for T2 and a timing value table (look-up table) for T3 are generated and provided in the process controller 38. Each of these tables includes address values corresponding to remaining toner amounts, in-apparatus temperature levels, and in-apparatus humidity levels that are parameters, in association with data to be read that is a delayed timing value at each of the parameter values.

$$T2=\{\text{startup time of image creating unit } 4k \text{ when filled-up with toner–startup time when containing no toner}\}\times(\text{remaining toner amount } \%/100)\times \text{in-apparatus temperature coefficient}\times\text{in-apparatus humidity coefficient}+\text{startup time when containing no toner} \quad (2)$$

in-apparatus temperature coefficient=function using in-apparatus temperature corresponding to toner material in image creating unit 4*k* as parameter, in-apparatus humidity coefficient=function using in-apparatus humidity corresponding to toner material in image creating unit 4*k* as parameter $$T3=\{\text{total startup time of image creating units } 4m, 4c, \text{ and } 4y \text{ when filled-up with toner–startup time when containing no toner}\}\times(\text{remaining toner amount } \%/100)\times \text{in-apparatus temperature coefficient}\times\text{in-apparatus humidity coefficient}+\text{startup time when containing no toner} \quad (3)$$

in-apparatus temperature coefficient=function using in-apparatus temperature corresponding to toner material in all of image creating units 4*m*, 4*c*, and 4*y* as parameter in-apparatus humidity coefficient=function using in-apparatus humidity corresponding to toner material in all of image creating units 4*m*, 4*c*, and 4*y* as parameter Referring back to FIG. 4, in step S5, table access is performed to derive T1, i.e., the process controller 38 provides the fixing temperature value to the delayed timing value table for T1, to read the delayed timing value T1 associated with this fixing temperature value. Furthermore, table access is performed to derive T2, i.e., the process controller 38 provides, to the timing value table for T2, the remaining toner amount in the image creating unit 4*k*, the in-apparatus temperature, and the in-apparatus humidity, to read the delayed timing value T2 associated with these parameter values. Moreover, table access is performed to derive T3, i.e., the process controller 38 provides, to the timing value table for T3, the total remaining toner amounts in the image creating units 4*m*, 4*c*, and 4*y*, the in-apparatus temperature, and the in-apparatus humidity, to read the delayed timing value T3 associated with these parameter values.

Next, the process controller 38 instructs a not shown fixing heater driver to start a temperature control operation for making the fixing temperature approach a target temperature (step S6). The process controller 38 determines whether the fixing temperature is more than or equal to a specified value that is slightly lower than the target temperature (step S7). If the fixing temperature is more than or equal to the specified value, the fixing roller is already heated, and therefore, the startup time will be short. Accordingly, the process controller 38 first starts up the first electric motor 21 (the fixing unit 17) (step S14). When T1 has passed from the point of this startup, the process controller 38 starts up the second electric motor 22 (the intermediate transfer belt 3 and the image creating unit 4*k*) (steps S15 and S16). When T2 has passed from the point of this startup, the process controller 38 starts up the third electric motor 23 (the image creating units 4*m*, 4*c*, and 4*y*) (steps S17 and S18).

However, if the fixing temperature is less than the specified value, the startup load of the fixing unit 17 will be large, and a relatively long time will be required for heating the fixing roller up to the target temperature. Accordingly, the process controller 38 first starts up the second electric motor 22 (step S8). When T2 has passed from the point of this startup, the process controller 38 starts up the third electric motor 23 (steps S9 and S10). When T3 has passed from the point of this startup, the process controller 38 starts up the first electric motor 21 (steps S11 and S12). When the above startup control operation is completed, the printer controller 33 performs "read input" (step S13), and awaits a printing instruction.

Reference is made to FIG. 5. When the printer controller 33 is waiting for a printing instruction, if the timer Td1 indicates "time over" before a printing instruction is received, the printer controller 33 sets the power source circuit to an "energy saving mode" so that power is stopped from being supplied to all electric circuits that consume power while the printer PTR is in a standby status, except for a resumption input detecting circuit for detecting a printing instruction or any other input indicating that the printer PTR is to be used (steps S13, S19, S22, S25, and S26).

However, if a color printing instruction is received at "read input" (step S13) during the "energy saving mode", the printer controller 33 performs color printing in collaboration with the process controller 38 and restarts the timer Td1 (steps S20, S21). When a monochrome printing instruction is received, the printer controller 33 performs monochrome printing and restarts the timer Td1 (steps S23, S24).

When a printing instruction is received during the aforementioned "energy saving mode", the resumption input detecting circuit turns on a power supply line of the power source circuit for starting up the printer controller 33. Accordingly, the printer controller 33 starts operating, sets the power source circuit to the "operation mode" and starts the timer Td1 (steps S27, S28). When the power source circuit is switched to the "operation mode", the process controller 38 instructs the fixing heater driver to start a fixing temperature control operation (step S29). According to the contents of the printing instruction (step S30), when the printing instruction is a color printing instruction, the process controller 38 starts up the second electric motor 22 (step S31). When T2 has passed from the point of this startup, the process controller 38 starts up the third electric motor 23 (steps S32 and S33). When T3 has passed from the point of this startup, the process controller 38 starts up the first electric motor 21 (steps S34 and S35). When the printing instruction is a monochrome printing instruction, the process controller 38 starts up the second electric motor 22 (step S36). When T2 has passed from the point of this startup, the process controller 38 starts up the first electric motor 21 (step S38), and does not start up the third electric motor 23. In this manner, when the mechanism starts operating in response to a printing instruction, the first electric motor 21 is started up last. This is because when the mechanism starts operating in response to a printing instruction, the printing operation most probably starts more quickly by first starting the image creating operation, instead of first conveying the printing sheet to a pair of registration rollers 15. For example, if the mechanism starts operating in response to a printing instruction when the fixing temperature is near the target temperature, the following will be realized. That is, in the case of monochrome printing, the image creating operation can start when the second electric motor 22 is completely started up. In the case of color printing, the image creating operation can start when the third electric motor 23 is completely started up after the second electric motor 22 is completely started up. Accordingly, the printing operation can be started quickly.

The developing unit driving load increases if the remaining toner amount is large, the temperature inside the apparatus is low, or the humidity inside the apparatus is high. Accordingly, the driving loads of image creating units including the developing units increase. This increases the startup currents of the electric motors driving the image creating units, and as a result, the startup time of the apparatus is extended. In this case, the time between the startup of one electric motor and the startup of another electric motor is extended (the startup timing of the other electric motor is delayed), so as to prevent a power shutdown of the apparatus. The shutdown is caused when startup currents of plural electric motors coincide with each other, which increases the total load. Hence, according to one embodiment of the present invention, an image forming apparatus is provided, in which startup loads of plural electric motors can be reliably distributed without particularly increasing the power source capacity, and without employing an electric circuit for detecting the startup current values of the electric motors.

According to one embodiment of the present invention, an image forming apparatus includes a photoconductor configured to rotate; a charging unit configured to charge the photoconductor; plural image creating units arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a first electric motor configured to drive the fixing unit; a second electric motor configured to drive at least one of the image creating units and drive the transfer belt; a third electric motor configured to drive at least one of the image creating units that is not driven by the second electric motor; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; and a startup control unit configured to startup each of the first electric motor, the second electric motor, and, according to need, the third electric motor, one at a time after the preceding one has been started up, wherein the electric motor to be started up after the second electric motor has been started up, is started up at a startup timing delayed with respect to the startup of the second electric motor, which startup timing is determined according to a state of the image creating unit driven by the second electric motor; and the electric motor to be started up after the third electric motor has been started up, is started up at a startup timing delayed with respect to the startup of the third electric motor, which startup timing is determined according to the state of the image creating unit driven by the third electric motor, wherein the state includes said remaining toner amount.

Additionally, the image forming apparatus further includes a temperature detecting unit configured to detect a temperature inside the image forming apparatus, wherein the timing setting unit determines the startup timing also according to the temperature, wherein the timing setting unit delays the startup timing in the event that the temperature is low; and the state includes said temperature.

Additionally, the image forming apparatus further includes a humidity detecting unit configured to detect a humidity inside the image forming apparatus, wherein the timing setting unit determines the startup timing also according to the humidity, wherein the timing setting unit delays the startup timing in the event that the humidity is high; and the state includes said humidity.

Additionally, the image forming apparatus further includes a fixing temperature detecting unit configured to detect a fixing temperature of the fixing unit, wherein in the event that the fixing temperature is less than a specified value, the startup control unit first starts up the second electric motor, and then starts up the third electric motor after the second electric motor has been started up at the startup timing determined according to the state of the image creating unit driven by the second electric motor, and then starts up the first electric motor after the third electric motor has been started up at the startup timing determined according to the state of the image creating unit driven by the third electric motor.

Additionally, in the image forming apparatus, in the event that the fixing temperature is more than or equal to the specified value, the startup control unit first starts up the first electric motor, and then starts up the second electric motor after the first electric motor has been started up at a startup timing determined for the first electric motor, and then starts up the third electric motor after the second electric motor has been started up at the startup timing determined according to the state of the image creating unit driven by the second electric motor.

Additionally, in the image forming apparatus, the timing setting unit determines the startup timing for the first electric motor according to the fixing temperature, wherein the timing setting unit delays the startup timing in the event that the fixing temperature is low.

According to one embodiment of the present invention, an image forming apparatus includes a photoconductor configured to rotate; a charging unit configured to charge the photoconductor; a black image creating unit, a magenta image creating unit, a cyan image creating unit, and a yellow image creating unit, which are arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a first electric motor configured to drive the fixing unit; a second electric motor configured to drive the black image creating unit and the transfer belt; a third electric motor configured to drive the magenta image creating unit, the cyan image creating unit, and the yellow image creating unit; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; and a startup control unit configured to start up the electric motors, wherein in the event of receiving a color printing instruction, the startup control unit first starts up the first electric motor, and then starts up the second electric motor after the first electric motor has been started up at a startup timing determined for the first electric motor, and then starts up the third electric motor after the second electric motor has been started up at a startup timing determined according to a state of the image creating unit driven by the second electric motor; and in the event of receiving a monochrome printing instruction, the startup control unit first starts up the second electric motor, and then starts up the first electric motor after the second electric motor has been started up at the startup timing determined according to the state of the image creating unit driven by the second electric motor, wherein the state includes said remaining toner amount.

Additionally, the image forming apparatus further includes a fixing temperature detecting unit configured to detect a fixing temperature of the fixing unit, wherein the timing setting unit determines the startup timing for the first electric motor according to the fixing temperature, wherein the timing setting unit delays the startup timing in the event that the fixing temperature is low.

According to one embodiment of the present invention, an image forming apparatus includes a photoconductor configured to rotate; a charging unit configured to charge the photoconductor; a black image creating unit, a magenta image creating unit, a cyan image creating unit, and a yellow image creating unit, which are arranged along a belt surface of a transfer belt, each of the image creating units including a combination of a developing unit and a transfer unit, wherein the developing unit is configured to turn an electrostatic latent image on the photoconductor into a toner image; an exposing unit configured to expose a charged surface of the photoconductor with light beams to form the electrostatic latent image; a fixing unit configured to fix the toner image transferred onto a sheet; a fixing temperature detecting unit configured to detect a fixing temperature of the fixing unit; an energy saving control unit configured to set a mode of the image forming apparatus, wherein an operation mode is set immediately after an original power source switch is switched on so that an operation voltage is supplied to units in the image forming apparatus, an energy saving mode is set if no printing instructions are received for a predetermined length of time so that power is stopped from being supplied to circuits in the image forming apparatus that consume a large amount of power, and the operation mode is set in response to receiving a printing instruction during the energy saving mode; a first electric motor configured to drive the fixing unit; a second electric motor configured to drive the black image creating unit and the transfer belt; a third electric motor configured to drive the magenta image creating unit, the cyan image creating unit, and the yellow image creating unit; a remaining toner amount detecting unit configured to detect a remaining toner amount in each of the developing units in the image creating units driven by the second electric motor and the third electric motor; a timing setting unit configured to determine a startup timing according to the remaining toner amount, wherein the timing setting unit delays the startup timing in the event that the remaining toner amount is large; a main power source activation startup control unit configured to start up the electric motors, wherein when the image forming apparatus is started up as the original power source switch is switched on, in the event that the fixing temperature is less than a specified value, the main power source activation startup control unit first starts up the second electric motor, and then starts up the third electric motor after the second electric motor has been started up at a startup timing determined according to a state of the image creating unit driven by the second electric motor, and then starts up the first electric motor after the third electric motor has been started up at a startup timing determined according to the state of the image creating unit driven by the third electric motor, and when the image forming apparatus is started up as the original power source switch is switched on, in the event that the fixing temperature is more than or equal to the specified value, the main power source activation startup control unit first starts up the first electric motor, and then starts up the second electric motor after the first electric motor has been started up at a startup timing determined for the first electric motor, and then starts up the third electric motor after the second electric motor has been started up at the startup timing determined according to the state of the image creating unit driven by the second electric motor; and a resumption startup control unit configured to start up the electric motors, wherein when the operation mode is set in response to receiving the printing instruction during the energy saving mode, in the event that the printing instruction is a color printing instruction, the resumption startup control unit first starts up the first electric motor, and then starts up the second electric motor after the first electric motor has been started up at the startup timing determined for the first electric motor, and then starts up the third electric motor after the second electric motor has been started up at the startup timing determined according to the state of the image creating unit driven by the second electric motor, and when the operation mode is set in response to receiving the printing instruction during the energy saving mode, in the event that the printing instruction is a monochrome printing instruction, the resumption startup control unit first starts up the second electric motor, and then starts up the first electric motor after the second electric motor has been started up at the startup timing determined according to the state of the image creating unit driven by the second electric motor, wherein the state includes said remaining toner amount.

Additionally, in the image forming apparatus, the timing setting unit determines the startup timing for the first electric motor according to the fixing temperature, wherein the timing setting unit delays the startup timing in the event that the fixing temperature is low.

Additionally, in the image forming apparatus, among the first, second, and third electric motors, at least the second and third electric motors are DC brushless motors.

The present invention is not limited to the specifically disclosed embodiment, and variations and modifications may be made without departing from the scope of the present invention.

The present application is based on Japanese Priority Patent Application No. 2006-272805, filed on Oct. 4, 2006, the entire contents of which are hereby incorporated by reference.

What is claimed is:

1. An image forming apparatus comprising:

a photoconductor configured to rotate;

a charging unit configured to charge the photoconductor;

plural image creating units arranged along a belt surface of a transfer belt, each of the image creating units comprising a combination of a developing unit and a transfer unit, wherein the developing unit is configured to turn an electrostatic latent image on the photoconductor into a toner image;

an exposing unit configured to expose a charged surface of the photoconductor with light beams to form the electrostatic latent image;

a fixing unit configured to fix the toner image transferred onto a sheet;

a first electric motor configured to drive the fixing unit;

a second electric motor configured to drive at least one of the image creating units and drive the transfer belt;

a third electric motor configured to drive at least one of the image creating units that is not driven by the second electric motor;

a remaining toner amount detecting unit configured to detect a remaining toner amount in each of the developing units in the image creating units driven by the second electric motor and the third electric motor;

a timing setting unit configured to determine a startup timing according to the remaining toner amount, wherein the timing setting unit delays the startup timing in the event that the remaining toner amount is large; and a startup control unit configured to start up each of the first electric motor, the second electric motor, and, according to need, the third electric motor, one at a time after the preceding one has been started up, wherein the electric motor to be started up after the second electric motor has been started up, is started up at a startup timing delayed with respect to the startup of the second electric motor, which startup timing is determined according to a state of the at least one of the image creating units driven by the second electric motor, the electric motor to be started up after the third electric motor has been started up, is started up at a startup timing delayed with respect to the startup of the third electric motor, which startup timing is determined according to a state of the at least one of the image creating units driven by the third electric motor, the state of the at least one of the image creating units driven by the second electric motor includes the remaining toner amount in the at least one of the image creating units driven by the second electric motor, and the state of the at least one of the image creating units driven by the third electric motor includes the remaining toner amount in the at least one of the image creating units driven by the third electric motor.

2. The image forming apparatus according to claim 1, further comprising:

a temperature detecting unit configured to detect a temperature inside the image forming apparatus, wherein the timing setting unit determines the startup timing also according to the temperature, the timing setting unit delays the startup timing in the event that the temperature is low; and the state of the at least one of the image creating units driven by the second electric motor and the state of the at least one of the image creating units driven by the third electric motor further include said temperature.

3. The image forming apparatus according to claim 1, further comprising:

a humidity detecting unit configured to detect a humidity inside the image forming apparatus, wherein the timing setting unit determines the startup timing also according to the humidity, the timing setting unit delays the startup timing in the event that the humidity is high, and the state of the at least one of the image creating units driven by the second electric motor and the state of the at least one of the image creating units driven by the third electric motor further include said humidity.

4. The image forming apparatus according to claim 1, further comprising:

a fixing temperature detecting unit configured to detect a fixing temperature of the fixing unit, wherein in the event that the fixing temperature is less than a specified value, the startup control unit first starts up the second electric motor, then starts up the third electric motor after the second electric motor has been started up at the startup timing determined according to the state of the at least one of the image creating units driven by the second electric motor, and then starts up the first electric motor after the third electric motor has been started up at the startup timing determined according to the state of the at least one of the image creating units driven by the third electric motor.

5. The image forming apparatus according to claim 4, wherein in the event that the fixing temperature is more than or equal to the specified value, the startup control unit first starts up the first electric motor, then starts up the second electric motor after the first electric motor has been started up at a startup timing determined for the first electric motor, and then starts up the third electric motor after the second electric motor has been started up at the startup timing determined according to the state of the at least one of the image creating units driven by the second electric motor.

6. The image forming apparatus according to claim 5, wherein:

the timing setting unit determines the startup timing for the first electric motor according to the fixing temperature, wherein the timing setting unit delays the startup timing in the event that the fixing temperature is low.

7. An image forming apparatus comprising:

a photoconductor configured to rotate;

a charging unit configured to charge the photoconductor;

a black image creating unit, a magenta image creating unit, a cyan image creating unit, and a yellow image creating unit, which are arranged along a belt surface of a transfer belt, each of the image creating units comprising a combination of a developing unit and a transfer unit, wherein the developing unit is configured to turn an electrostatic latent image on the photoconductor into a toner image;

an exposing unit configured to expose a charged surface of the photoconductor with light beams to form the electrostatic latent image;

a fixing unit configured to fix the toner image transferred onto a sheet;

a first electric motor configured to drive the fixing unit;

a second electric motor configured to drive the black image creating unit and the transfer belt;

a third electric motor configured to drive the magenta image creating unit, the cyan image creating unit, and the yellow image creating unit;

a remaining toner amount detecting unit configured to detect a remaining toner amount in each of the developing units in the image creating units driven by the second electric motor and the third electric motor;

a timing setting unit configured to determine a startup timing according to the remaining toner amount, the timing setting unit delaying the startup timing in the event that the remaining toner amount is large; and a startup control unit configured to start up the electric motors, wherein in the event of receiving a color printing instruction, the startup control unit first starts up the first electric motor, then starts up the second electric motor after the first electric motor has been started up at a startup timing determined for the first electric motor, and then starts up the third electric motor after the second electric motor has been started up at a startup timing determined according to a state of the image creating unit driven by the second electric motor, in the event of receiving a monochrome printing instruction, the startup control unit first starts up the second electric motor, and then starts up the first electric motor after the second electric motor has been started up at the startup timing determined according to the state of the image creating unit driven by the second electric motor, and the state of the image creating unit driven by the second electric motor includes said remaining toner amount.

8. The image forming apparatus according to claim 7, further comprising:

a temperature detecting unit configured to detect a temperature inside the image forming apparatus, wherein the timing setting unit determines the startup timing also according to the temperature, the timing setting unit delays the startup timing in the event that the temperature is low, and the state of the image creating unit driven by the second electric motor further includes said temperature.

9. The image forming apparatus according to claim 7, further comprising:

a humidity detecting unit configured to detect a humidity inside the image forming apparatus, wherein the timing setting unit determines the startup timing also according to the humidity, the timing setting unit delays the startup timing in the event that the humidity is high, and the state of the image creating unit driven by the second electric motor further includes said humidity.

10. The image forming apparatus according to claim 7, further comprising:

a fixing temperature detecting unit configured to detect a fixing temperature of the fixing unit, wherein:

the timing setting unit determines the startup timing for the first electric motor according to the fixing temperature, wherein the timing setting unit delays the startup timing in the event that the fixing temperature is low.

11. An image forming apparatus comprising:

a photoconductor configured to rotate;

a charging unit configured to charge the photoconductor;

a black image creating unit, a magenta image creating unit, a cyan image creating unit, and a yellow image creating unit, which are arranged along a belt surface of a transfer belt, each of the image creating units including a combination of a developing unit and a transfer unit, the developing unit configured to turn an electrostatic latent image on the photoconductor into a toner image;

an exposing unit configured to expose a charged surface of the photoconductor with light beams to form the electrostatic latent image;

a fixing unit configured to fix the toner image transferred onto a sheet;

a fixing temperature detecting unit configured to detect a fixing temperature of the fixing unit;

an energy saving control unit configured to set a mode of the image forming apparatus, wherein an operation mode is set immediately after an original power source switch is switched on so that an operation voltage is supplied to units in the image forming apparatus, an energy saving mode is set if no printing instructions are received for a predetermined length of time so that power is stopped from being supplied to circuits in the image forming apparatus which circuits consume a large amount of power, and the operation mode is set in response to receiving a printing instruction during the energy saving mode;

a first electric motor configured to drive the fixing unit;

a second electric motor configured to drive the black image creating unit and the transfer belt;

a third electric motor configured to drive the magenta image creating unit, the cyan image creating unit, and the yellow image creating unit;

a remaining toner amount detecting unit configured to detect a remaining toner amount in each of the developing units in the image creating units driven by the second electric motor and the third electric motor;

a timing setting unit configured to determine a startup timing according to the remaining toner amount, wherein the timing setting unit delays the startup timing in the event that the remaining toner amount is large;

a main power source activation startup control unit configured to start up the electric motors, wherein when the image forming apparatus is started up as the original power source switch is switched on, in the event that the fixing temperature is less than a specified value, the main power source activation startup control unit first starts up the second electric motor, then starts up the third electric motor after the second electric motor has been started up at a startup timing determined according to a state of the image creating unit driven by the second electric motor, and then starts up the first electric motor after the third electric motor has been started up at a startup timing determined according to a state of the image creating unit driven by the third electric motor, when the image forming apparatus is started up as the original power source switch is switched on, in the event that the fixing temperature is more than or equal to the specified value, the main power source activation startup control unit first starts up the first electric motor, then starts up the second electric motor after the first electric motor has been started up at a startup timing determined for the first electric motor, and then starts up the third electric motor after the second electric motor has been started up at the startup timing determined according to the state of the image creating unit driven by the second electric motor; and a resumption startup control unit configured to start up the electric motors, when the operation mode is set in response to receiving the printing instruction during the energy saving mode, in the event that the printing instruction is a color printing instruction, the resumption startup control unit first starts up the first electric motor, then starts up the second electric motor after the first electric motor has been started up at the startup timing determined for the first electric motor, and then starts up the third electric motor after the second electric motor has been started up at the startup timing determined according to the state of the image creating unit driven by the second electric motor, when the operation mode is set in response to receiving the printing instruction during the energy saving mode, in the event that the printing instruction is a monochrome printing instruction, the resumption startup control unit first starts up the second electric motor, and then starts up the first electric motor after the second electric motor has been started up at the startup timing determined according to the state of the image creating unit driven by the second electric motor, and the state of the image creating unit driven by the second electric motor and the state of the image creating unit driven by the third electric motor include said remaining toner amount.

12. The image forming apparatus according to claim 11, further comprising:

a temperature detecting unit configured to detect a temperature inside the image forming apparatus, wherein the timing setting unit determines the startup timing also according to the temperature, the timing setting unit delaying the startup timing in the event that the temperature is low, and the state of the image creating unit driven by the second electric motor and the state of the image creating unit driven by the third electric motor further include said temperature.

13. The image forming apparatus according to claim 11, further comprising:

a humidity detecting unit configured to detect a humidity inside the image forming apparatus, wherein the timing setting unit determines the startup timing also according to the humidity, the timing setting unit delays the startup timing in the event that the humidity is high, and the state of the image creating unit driven by the second electric motor and the state of the image creating unit driven by the third electric motor further include said humidity.

14. The image forming apparatus according to claim 11, wherein:

the timing setting unit determines the startup timing for the first electric motor according to the fixing temperature, wherein the timing setting unit delays the startup timing in the event that the fixing temperature is low.

15. The image forming apparatus according to claim 1, wherein:

among the first, second, and third electric motors, at least the second and third electric motors are DC brushless motors.

16. The image forming apparatus according to claim 7, wherein:

among the first, second, and third electric motors, at least the second and third electric motors are DC brushless motors.

17. The image forming apparatus according to claim 11, wherein:

among the first, second, and third electric motors, at least the second and third electric motors are DC brushless motors.

* * * * *

UNITED STATES PATENT AND TRADEMARK OFFICE

CERTIFICATE OF CORRECTION

PATENT NO. : 7,751,755 B2
APPLICATION NO. : 11/905673
DATED : July 6, 2010
INVENTOR(S) : Yasuo Yamaguchi It is certified that error appears in the above-identified patent and that said Letters Patent is hereby corrected as shown below:

Title Page item (73) Assignee should read as follows: Ricoh Company, Ltd.,Tokyo (JP)

Signed and Sealed this

Twenty-third Day of November, 2010

David J. Kappos

David J. Kappos
*Director of the United States Patent and Trademark Office*